United States Patent [19]

Kucher et al.

[11] 4,340,445

[45] Jul. 20, 1982

[54] CAR FOR RECEIVING INCANDESCENT COKE

[76] Inventors: Valery N. Kucher, ulitsa § maya, 15, kv. 25; Alexandr Z. Popenko, ulitsa Prigorodnava, 68; Georgy R. Reiman, ulitsa Syrovtsa, 2/28, kv. 79; Mikhail I. Durachenko, ulitsa Lesopilnaya, 1/28, kv. 79; Grigory D. Zhovtobrjukh, Komsomolsky prospekt, 20, kv. 40, all of Dneprodzerzhinsk, U.S.S.R.

[21] Appl. No.: 223,683

[22] Filed: Jan. 9, 1981

[51] Int. Cl.[3] ..... C10B 35/00

[52] U.S. Cl. ..... 202/262; 202/230

[58] Field of Search ..... 202/227, 230, 262

[56] References Cited

U.S. PATENT DOCUMENTS 1,365,974 1/1921 Flood et al. ..... 202/227

FOREIGN PATENT DOCUMENTS 313989 7/1919 Fed. Rep. of Germany ..... 202/230

OTHER PUBLICATIONS

Coke Dry Quenching, M. G. Teplitskii, I. Z. Gordon, N. A. Kudriavaya, M. S. Kruchinin, and Yu. M. Volovitch, Metallurgiya Publishers, 1971, p. 204.

*Primary Examiner*—Norman Yudkoff

*Attorney, Agent, or Firm*—Steinberg & Raskin

[57] ABSTRACT

In a car for receiving incandescent coke and transporting it from a coking chamber to a quenching site a wall structure (3) surrounded by a girder (8) at the lower end portion thereof and removably mounted on a bunker (6) which in turn is surrounded by a girder (12) at the upper portion thereof so that the girder (8) is unrestricted on the girder (12) for linear expansion under the action of heat from the incandescent coke. Examples of the girders (8) and (12) are furnished.

5 Claims, 7 Drawing Figures

CAR FOR RECEIVING INCANDESCENT COKE

TECHNICAL FIELD

The present invention relates to the processing equipment of coke-producing plants and, more particularly, to a car for receiving incandescent coke, whereupon the coke is transported in the car from a coking chamber to the quenching site. The invention may provide most advantageous when utilized in the works where dry quenching of coke is a current technique.

BACKGROUND ART

In coking plants incandescent coke is transported from a coking chamber to a quenching site preferably by cars adapted to move on rails (N. G. Teplitsky et al. "Sukhoye tushenie koksa" published in 1971 by "Metallirgia" Publishers Moscow, see page 53). Such cars comprise an all-welded body removably mounted on an undercarriage and having a bunker and a wall structure which includes a girder disposed around the outer face thereof at the junction with the bunker and carries a coke-receiving chute.

The body of the prior art cars is lined with metal sheets.

In the prior art cars a non-uniform expansion of metal occurs at the junction of the bunker with the wall structure under the action of heat from the incandescent coke, which results in structural failure at the junction and, therefore, in shorter service life.

DISCLOSURE OF INVENTION

The invention contemplates the provision of a car for receiving incandescent coke, wherein change in relationship between the bunker and the wall structure eliminates body failure at the junction of the bunker with the wall structure and, therefore, extends service life thereof.

Accordingly, there is provided a car for receiving incandescent coke and transporting it from a coking chamber to a quenching site, comprising a body removably mounted on an undercarriage and having a bunker and a wall structure which includes a girder disposed around the outer face thereof adjacent the junction to the bunker and carries a coke-receiving chute, wherein, according to the invention, the wall structure is detachably mounted on the bunker which is provided with a girder disposed around the upper end portion thereof and in contact with the girder of the wall structure so as to provide for linear expansion under the action of heat from the incandescent coke.

Such car has a longer service life as compared with the prior art cars of the kind described, inasmuch as the bunker structure and the wall structure, being mounted for linear expansion, do not interfere with each other, i.e. the effect of thermal strain in the wall structure and the bunker at the junction thereof is eliminated which heretofore gave rise to weak locations.

In view of the fact that the car of the invention, in operation, is subjected to various dynamic loads, it is reasonable to provide means for eliminating misalignment between the girders. With this end in view the invention may be variously otherwise embodied.

Thus, one of the girders may be of an L-shaped cross-sectional configuration or may have a groove extending along the length thereof, while the other girder is received within the groove. Also, the girders may be interconnected by means of a bolt and nut arrangement holding them in position.

The car so constructed makes it possible to improve its maintainability and to extend entire service life. With this end in mind the cars may be assembled from interchangeable unified parts, such as a coke-receiving chute, side wall structural parts, and additional sections constituting a wall structure which are adapted to be installed on the basic wall structure. This makes it possible to accumulate a back-up stock of such parts and repair the cars by changing parts and complete assemblies of their body. It also makes it possible to vary the body dimensions in conformity with the capacity of the coking ovens, for example from 41.6 $m^3$ to 32.3 $m^3$.

BRIEF DESCRIPTION OF DRAWINGS

Now the invention will be clear from the following detailed description thereof, taken in conjunction with the accompanying drawings, in which.

BEST MODE FOR CARRYING OUT THE INVENTION

Figure 1:
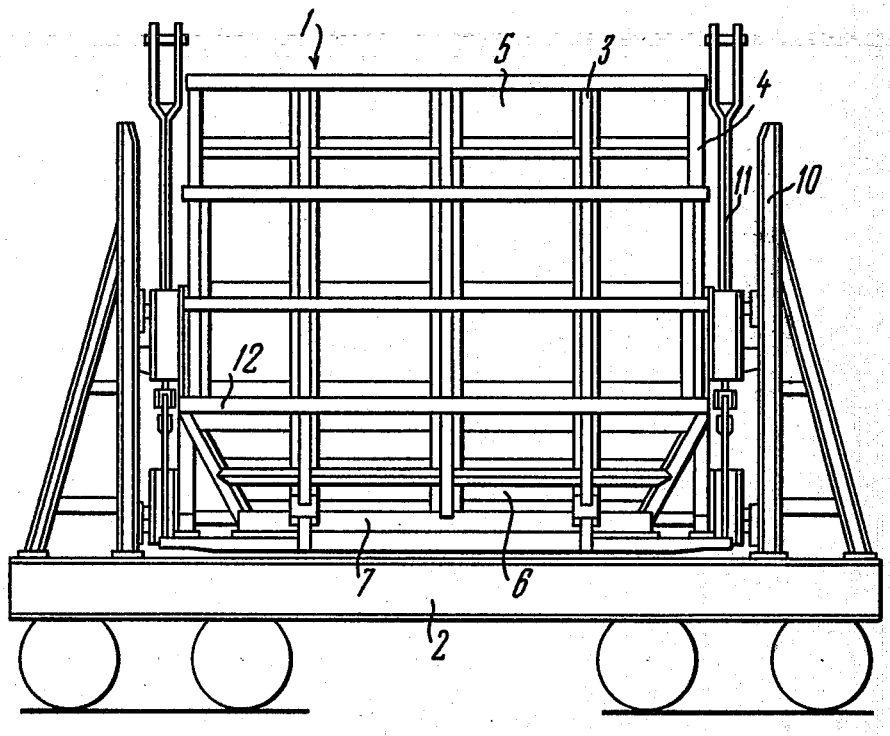
FIG. 1 is a front elevation of the car according to the invention.

Referring to FIG. 1, a car of the invention comprises a body 1 removably mounted on an undercarriage 2 adapted to move on the rails (not shown) as incandescent coke is transported from a coking chamber to a quenching site. The body 1 includes a wall structure 3 commonly composed of end walls 4 and side walls 5, and a bunker 6 having a discharge opening normally closed by a bottom gate 7. The wall structure 3 is provided with a girder 8 disposed around the lower end portion thereof as at the junction of the bunker 6 with the wall structure 3. The wall structure 3 supports a coke-receiving chute 9. The undercarriage 2 is equipped with conventional means for lifting the body 1, such as guides 10 and rods 11.

Figure 2:
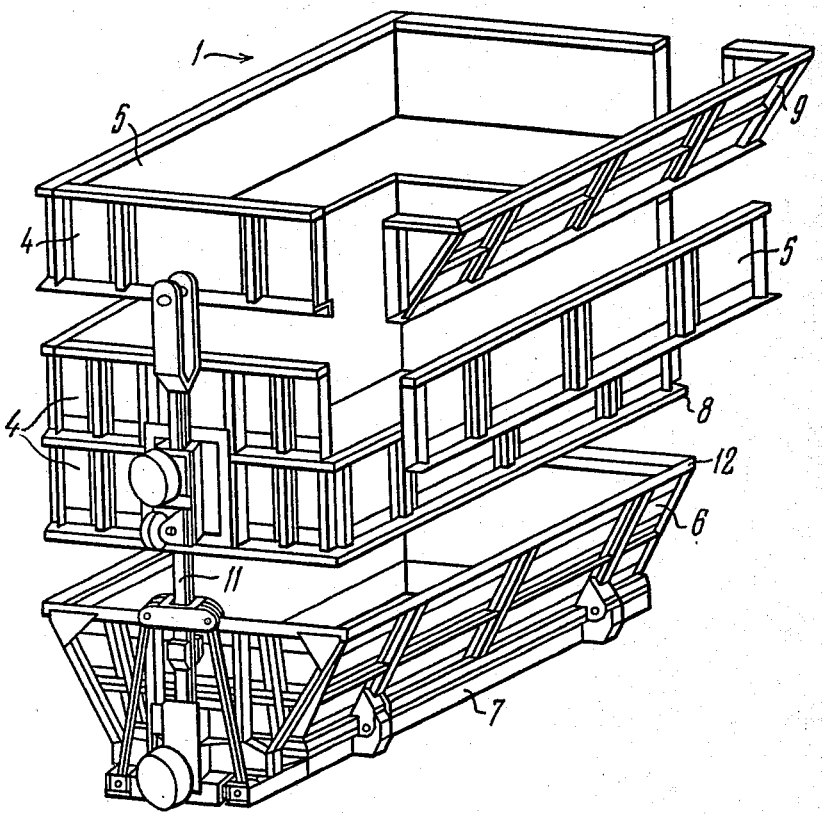
FIG. 2 is an exploded perspective representation of the body of the car according to the invention.

According to the invention the wall structure 3 is detachably mounted on the bunker 6. To this end the bunker 6 (FIG. 2) is provided with a girder 12 disposed around the upper end portion thereof and in contact with the girder 8, that is the wall structure 3 is mounted on the bunker 6 so that the girders 8 and 12 of the wall structure 3 and the bunker 6 respectively linearly expand as heat of the incandescent coke acts thereon.

Figure 7:
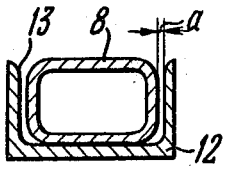
FIGS. 5, 6 and 7 are modified forms of the girders of the bunker and of the wall structure.
Figure 6:
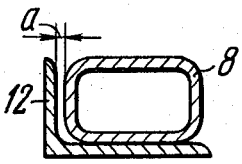
Figure 5:
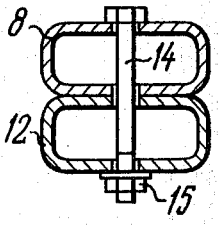

As shown in FIGS. 6 and 7 the girders 8 and 12 are shaped so as to eliminate possible misalignment between them and, consequently, between the wall structure 3 and the bunker 6. FIG. 6 shows the girder 12 having an L-shaped cross-sectional configuration, while FIG. 7 shows the girder 12 having a groove 13 extending along the length of the girder and the girder 8 being received within the groove. It is to be appreciated that the member having the groove 13 is a rolled shape such as a channel iron, H or I beams and so on. If the girder 12 is shaped as in FIGS. 6 and 7, free expansion of the girder 8 should evidently be ensured, and is ensured by leaving a gap "a" between vertically extending surfaces of the adjacent girders. If a more reliable relationship between the wall structure 3 and the bunker 6 is desired in view of the service conditions for the car of the invention, it can be provided by utilizing a bolt 14 and a nut 15 or any other suitable holding arrangement capable of holding the girders 8 and 12 in position. That the bolt 14 and the nut 15 as shown in FIG. 5, hold the girders 8 and 12 aligned and provide for thermal expansion of the girders and the other parts of the body 1 will be readily understood by a person having ordinary skill in the pertinent art.

Figure 4:
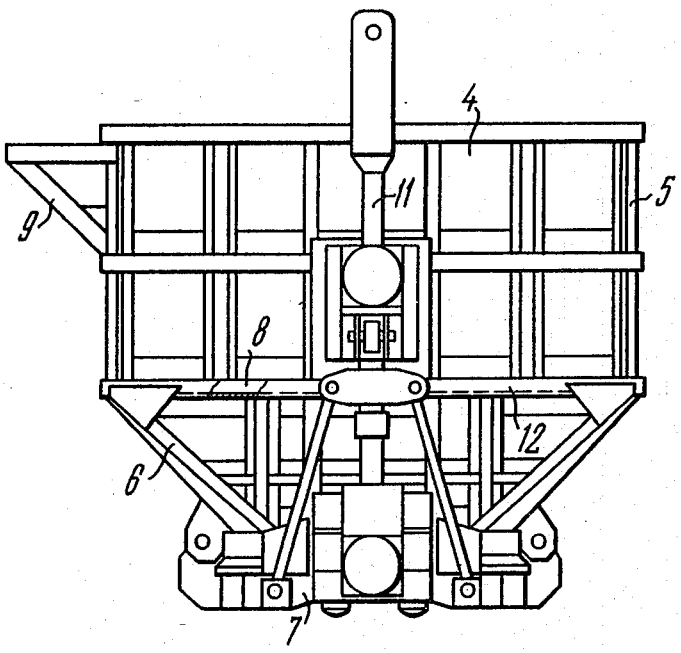
FIG. 4 is an end elevation of the body of the car of the invention, having an alternative capacity, e.g. 32.3 $m^3$.

If such rapidly wearing members as lining and the metal structures of the gate 7 and the bunker 6 fail, they are removed and replaced by spares from the back-up stock. Specific dimensions of the body 1 may be changed to suit either of the ovens serviced (41.6 $m^3$ and 32.3 $m^3$) by dismantling or mounting the end 4 and side 5 walls and the coke-receiving chute 9 so as to suit the design of the car (FIGS. 2 and 4) either at the manufacturing plant or at the site of service.

Figure 3:
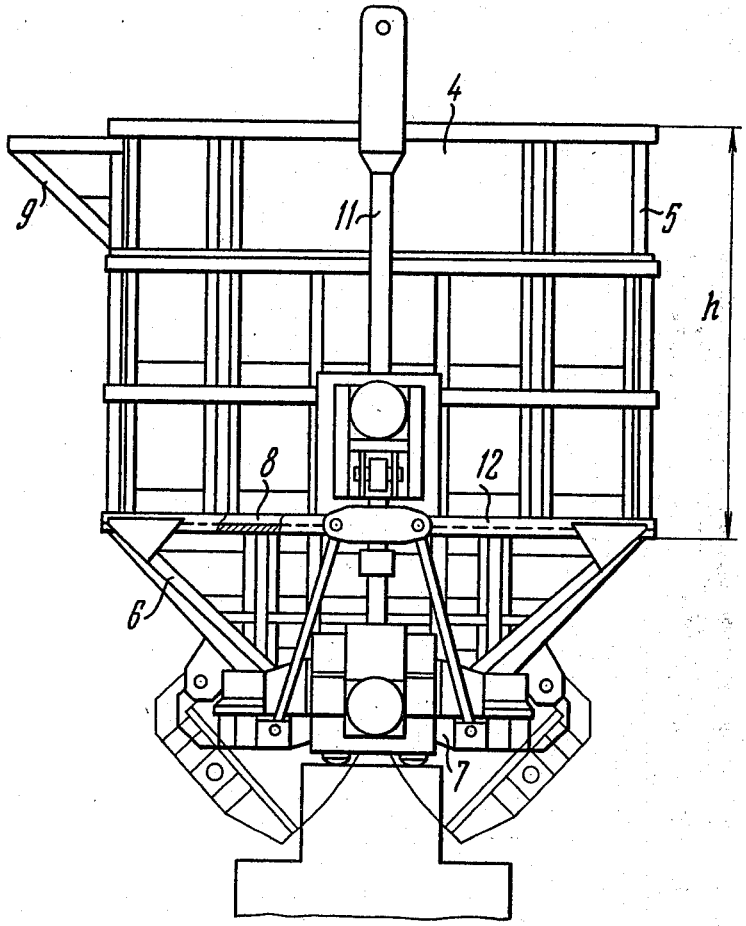
FIG. 3 is an end elevation of the body of the car of the invention, having a predetermined capacity, e.g. 41.6 $m^3$.

The body can be rebuilt for the coking ovens of 50 $m^3$ capacity at the manufacturing plant by changing the height "h" (FIG. 3) of the wall structure 3, all the other components being unchanged.

We claim:

1. A car for receiving incandescent coke and transporting it from a coking chamber to a quenching site, comprising a body removably mounted on an undercarriage and having a bunker and a wall structure which includes a wall girder disposed around the outer face thereof adjacent the junction to the bunker and carries a coke-receiving chute characterized in that the wall structure is detachably mounted on the bunker, and wherein said bunker is provided with a bunker girder disposed around the upper end portion thereof, said bunker girder being in contact with the wall girder so as to provide for free linear expansion for each of the respective girders under the action of heat from the incandescent coke, whereby the effect of thermal strain in the wall structure and the bunker is eliminated.

2. A car as claimed in claim 1, characterized in that one of the wall and bunker girders has an L-shaped cross-sectional configuration to prevent the girders from being misaligned relative each other.

3. A car as claimed in claim 1, characterized in that one of the wall and bunker girders has a groove extending along the length thereof, and wherein the other girder is received within said groove.

4. A car as claimed in claim 3, characterized in that each of the wall and bunker girders include vertically extending walls and a gap is defined between adjacent vertical walls of the respective girders when the one girder is received within said groove.

5. A car as claimed in claims 2 or 3, characterized in that both the wall and bunker girders are interconnected by a bolt and a nut which hold them in aligned position and which permit thermal expansion of the girders.

* * * * *